US011946336B1

(12) United States Patent
Al-Mousa et al.

(10) Patent No.: US 11,946,336 B1
(45) Date of Patent: Apr. 2, 2024

(54) ISOLATING A SECTION OF A WELLBORE

(71) Applicant: Saudi Arabian Oil Company, Dhahran (SA)

(72) Inventors: Ahmed Abdulaziz Al-Mousa, Dhahran (SA); Enrique Avila Faull, Dhahran (SA); Abdulaziz Al-Mutawa, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/945,805

(22) Filed: Sep. 15, 2022

(51) Int. Cl.
*E21B 33/16* (2006.01)
*E21B 34/14* (2006.01)

(52) U.S. Cl.
CPC ..... *E21B 33/16* (2013.01); *E21B 34/142* (2020.05)

(58) Field of Classification Search
CPC ..... E21B 33/16; E21B 33/165; E21B 34/142; E21B 2200/06
See application file for complete search history.

(56) References Cited

U.S. PATENT DOCUMENTS

2015/0345252 A1* 12/2015 Mcnabb ..... E21B 33/146 166/318
2016/0024877 A1* 1/2016 Coronado ..... E21B 34/10 166/177.4
2016/0084034 A1* 3/2016 Roane ..... E21B 33/126 166/377
2019/0186240 A1* 6/2019 Fitzhugh ..... E21B 23/01
2020/0056446 A1* 2/2020 Al-Mousa ..... E21B 33/1293

FOREIGN PATENT DOCUMENTS

CA 2837997 3/2014

* cited by examiner

*Primary Examiner* — Christopher J Sebesta
(74) *Attorney, Agent, or Firm* — Fish & Richardson P.C.

(57) ABSTRACT

A method includes deploying a cementing assembly within a wellbore that is at least partially open hole. The method also includes setting the cementing assembly at a target zone of the wellbore by setting a first packer of the cementing assembly downhole of the target zone. The method also includes flowing, through the wellbore string and through the cementing assembly, cement to an annulus at the target zone. The annulus is defined between an exterior surface of the cementing assembly and a wall of the wellbore. The method also includes setting, with the wellbore string, a second packer of the cementing assembly. The second packer is disposed uphole of the first packer and uphole of the target zone.

20 Claims, 4 Drawing Sheets

ISOLATING A SECTION OF A WELLBORE

FIELD OF THE DISCLOSURE

This disclosure relates to wellbores, in particular, to methods and equipment for cementing and isolating wellbores.

BACKGROUND OF THE DISCLOSURE

Wellbore cementing can be used to seal portions of a wellbore. Isolating sections of a wellbore with cement involves flowing a cement slurry to a downhole location of the wellbore to create a wall that isolates the production fluid from the cemented region of the wellbore. Tubes and liners can be used to cement a portion of the wellbore. Methods and equipment for improving cementing operations are sought.

SUMMARY

Implementations of the present disclosure include a method that includes deploying, with a wellbore string coupled to a cementing assembly, the cementing assembly within a wellbore that is at least partially open hole. The method also includes setting the cementing assembly at a target zone of the wellbore by setting a first packer of the cementing assembly downhole of the target zone. The method also includes flowing, through the wellbore string and through the cementing assembly, cement to an annulus at the target zone. The annulus is defined between an exterior surface of the cementing assembly and a wall of the wellbore. The method also includes setting, with the wellbore string, a second packer of the cementing assembly. The second packer is disposed uphole of the first packer and uphole of the target zone.

In some implementations, setting the first packer comprises hydraulically setting the first packer, and setting the second packer comprises mechanically setting the second packer.

In some implementations, setting the first packer comprises placing a ball on a ball seat of the cementing assembly to close a fluid pathway of the cementing assembly, and pressurizing, with the fluid pathway closed, the cementing assembly to a first fluid pressure to activate the first packer.

In some implementations, the method further includes, before flowing the cement and after setting the first packer, opening, by pressurizing the cementing assembly to a second fluid pressure greater than the first fluid pressure, a valve configured to regulate a flow of fluid between a bore of the cementing assembly and the annulus.

In some implementations, the valve comprises a cementing circulating valve disposed between the first packer and the second packer, and opening the valve comprises moving a sleeve of the valve to expose an aperture of a wall of the cementing assembly.

In some implementations, flowing the cement comprises flowing a wiper plug uphole of the cement to push the cement to the annulus.

In some implementations, the method further includes, before setting the second packer and after flowing the cement, closing, by pressurizing the cementing assembly to a third fluid pressure greater than the second fluid pressure, the valve to prevent fluid from flowing between the annulus and the bore of the cementing assembly.

In some implementations, the method further includes, before setting the second packer and after flowing the cement, detaching, by pressurizing the cementing assembly to a fourth fluid pressure greater than the second fluid pressure, the wellbore string from the cementing assembly, and setting the second packer comprises engaging, with the wellbore string, a setting profile of the second packer to activate the packer by mechanical movement of the wellbore string.

In some implementations, detaching the wellbore string from the cementing assembly comprises at least one of: breaking a shear pin securing the wellbore string to the cementing assembly or deactivating a connection assembly securing the wellbore string to the cementing assembly.

Implementations of the present disclosure include an assembly that includes a wellbore string that is disposed within a wellbore. The assembly also includes a cementing assembly attached to and fluidly coupled to the wellbore string. The cementing assembly includes a housing, a first packer attached to the housing and configured to be activated hydraulically, and a second packer attached to the housing uphole of the first packer. The second packer is activated mechanically. The wellbore string directs, with the first packer set on a well of the wellbore, cement to an annulus defined between an external surface of the housing and the wall of the wellbore, and the wellbore string mechanically sets, after cementing the annulus, the second packer. The annulus is bounded between the first packer and the second packer.

In some implementations, the cementing assembly comprises a ball seat configured to receive a ball that closes a fluid pathway of the cementing assembly to allow pressurization of the cementing assembly to set the first packer at a first fluid pressure.

In some implementations, the cementing assembly comprises a float shoe disposed downhole of the ball seat, the float shoe configured to prevent reverse flow of fluid from downhole the float shoe into the cementing assembly.

In some implementations, the cementing assembly comprises a valve configured to open under a second fluid pressure greater than the first fluid pressure, exposing a fluid port to allow cement to flow from a bore of the housing to the annulus.

In some implementations, the valve is configured to close under a third fluid pressure greater than the second fluid pressure, blocking the fluid port.

In some implementations, the wellbore string is releasably coupled to the cementing assembly, and the wellbore string is configured to detach, under a fourth fluid pressure greater than the second fluid pressure, from the cementing assembly to allow the wellbore string to engage a setting profile of the second packer to set the second packer.

In some implementations, the first packer comprises a first open hole packer and the second packer comprises a second open hole packer, and the setting packer comprises setting the first packer on an open hole wall of the wellbore and setting the second packer on the open hole wall of the wellbore.

DETAILED DESCRIPTION OF THE DISCLOSURE

The present disclosure describes a cementing assembly used for zonal isolation operations. The assembly includes two packers that are set on an open hole of the wellbore to bound the section to be isolated. The assembly directs cement to the zone to form a wall in the annulus and allow production from downhole or uphole of the assembly.

In conventional or workover wellbores, the need to isolate a section of an open hole reservoir due to unwanted fluids is common but the process can be complex, costly and lengthy. Implementations of the present disclosure are intended to isolate a section of the open hole without limiting the access to the open hole nor hindering the production regardless the location of the device in the open hole.

Particular implementations of the subject matter described in this specification can be implemented so as to realize one or more of the following advantages. For example, the cementing assembly of the present disclosure can help cement a wellbore with a lost circulation zone in one trip. Additionally, the assembly can isolate long sections of a wellbore with different reservoirs, impeding fluid cross flow between the formations and increasing the life of the assembly and therefore of the well. Additionally, the cementing assembly allows the well to produce from below the wellbore assembly, avoiding undesirable fluid production.

Figure 1:
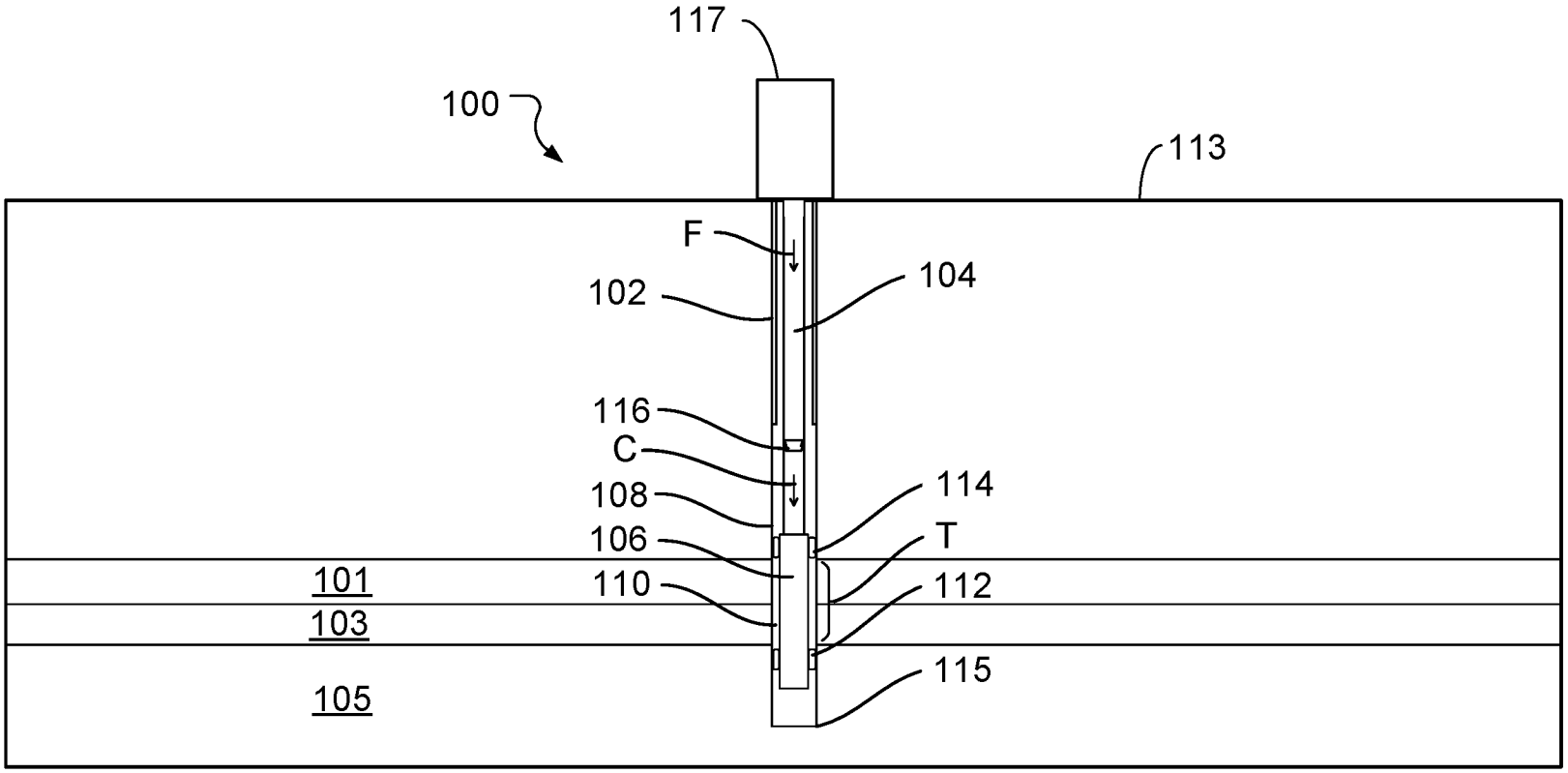
FIG. 1 is a front schematic view, partially cross sectional, of a wellbore assembly according to implementations of the present disclosure.

FIG. 1 shows a wellbore assembly 100 used to cement or isolate a section of a wellbore 102. The wellbore 120 extends from a terranean surface 113 of the wellbore 120 to a downhole end 115 of the wellbore 102. The wellbore 102 can be vertical or non-vertical. The wellbore 102 is formed in one or more geologic formation 101, 103, 105. At least one of the formations can include a hydrocarbon reservoir from which hydrocarbons can be extracted. For example, the last formation 105 can be a reservoir formation with hydrocarbons and the other formations 101, 103 can include undesirable fluids such as water or brine (or a lost circulation zone).

The wellbore assembly 100 includes a wellbore string 104 (e.g., a drill string, a production string, or a work string) and a cementing assembly or isolation kit 106. The cementing assembly 104 is used to perform zonal isolation operations for various reasons, such as to isolate one or more formations, plugging a lost circulation zone, remedial cementing, etc. For example, the cementing assembly 106 can be used to isolate two formations 101, 103 from a reservoir formation 105 during hydrocarbon production. The cementing assembly 106 has two packers (or sets of packers) 112, 114 used to set the cementing assembly 106 on the wellbore and to isolate the desired section of the wellbore 102. The packers 112, 114 can be open hole packers that are set on an open hole section 108 of the wellbore 102.

The wellbore assembly 100 is attached to surface equipment 117 such as a wellhead, a rig, or a crane. The surface equipment 117 lowers the wellbore assembly 100 within the wellbore 102 to position the cementing assembly 106 at a target zone "T" that is to be isolated. The target zone "T" can include formations 101, 103. The target zone "T" is between the two packers 112, 114. To isolate the target zone "T," wellbore string 102 directs cement "C" pumped from the surface 113 to the cementing assembly 106 and into an annulus 110. The annulus is at the target zone "T." The annulus 110 is defined between an external surface of the cementing assembly 106 and the wall of the wellbore 102. The cement "C" can be pushed by a wiper plug 116 that is pushed by a fluid "F" (e.g., water or mud).

Figure 2:
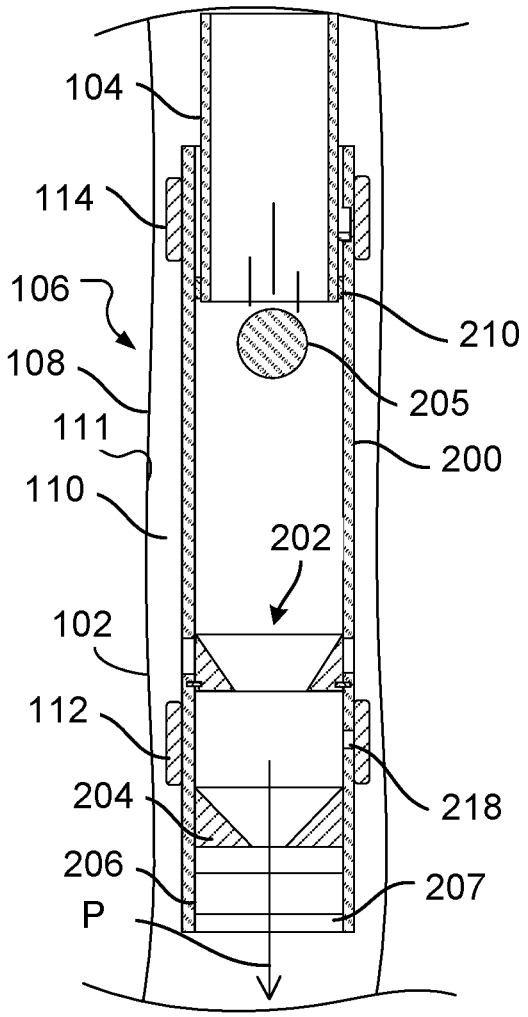
FIGS. 2-5 are front schematic views, cross sectional, of sequential steps to isolate a zone of a wellbore.

As shown in FIG. 2, the cementing assembly 106 has a housing 200, float equipment 206 (e.g., a float shoe 207 and/or float collar) attached to the housing 200, a ball seat 204 attached to the housing 200, and a valve 202 attached to the housing 200. The housing 200 is tube that can serve as a short liner.

The cementing assembly 106 is fluidly coupled and releasably attached to the wellbore string 104 by a coupling 210 (e.g., a shear pin, a retractable fastener or anchor, etc.). Thus, the wellbore string 104 (e.g., a drill string) can set the cementing assembly 106, cement and isolate the section of the wellbore, and continue to drill downhole of the cementing assembly 106.

The float shoe 207 is disposed downhole of the ball seat 204. The float shoe 207 can have a check valve that prevents reverse flow of fluid from downhole the float shoe 207 into the housing 200 of the cementing assembly 106.

To perform the zonal isolation operation, the cementing assembly 106 can be first selected and assembled at the surface based on the diameter of the open hole 108. For example, if the diameter of the open hole is around 6.125 inches, the cementing assembly 106 (e.g., the housing 200) can have an external diameter of about 4.5 inches.

Figure 3:
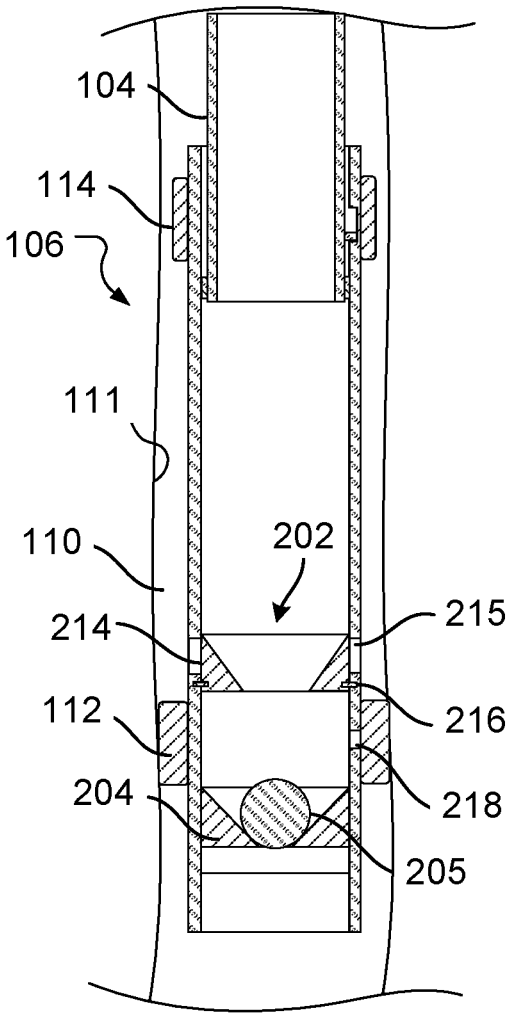

The cementing assembly 106 is lowered to the desired depth at the target zone. Once the cementing assembly 106 is at the target zone, the first packer (or first set of packers) 112 is activated to secure the cementing assembly 106 to the wellbore 102. To activate the first packer 112, a ball 205 is dropped from the surface of the wellbore 102 to land on the ball seat 204. The ball 205 closes the main fluid pathway "P" of the cementing assembly 106. Referring also to FIG. 3, once the main fluid pathway "P" is closed, the wellbore string 104 flows fluid downhole to pressurize the wellbore assembly 106 to a first pressure. For example, the first pressure may be between 500 and 1500 psi (e.g., 1000 psi). The pressurized fluid enters a fluid channel 218 with a pressure-activated switch or a latch that releases at a known pressure. Releasing the latch activates or releases the packer 112 to expand and engage the wall 111 of the open hole 108.

Once the first packer 112 is set, the valve 202 is opened to flow cement into the annulus 110. The valve 202 can be a cementing circulating valve. The cementing circulating valve is between the first packer 112 and the second packer 114. The valve 202 opens, under a second fluid pressure greater than the first pressure, to expose ports 215 and allow cement to flow from a bore of the cementing assembly 106 to the annulus 110. The second pressure can be, for example, between 1000 and 2000 psi (e.g., 1500 psi). For example, the valve 202 can have a mechanism that is activated by a pressure greater than the first pressure. For example, the valve can have a sleeve 214 releasably coupled to the housing of the cementing assembly 106 by shear pins 216 or a different coupling such as a retractable latch. The sleeve 214 has a reduced downhole end to create resistance and allow the pressure to bias the sleeve downhole to break the shear pin 216. The sleeve 214 can be a spring-loaded sleeve with a spring that is designed to allow movement of the sleeve under a certain pressure.

Figure 4:
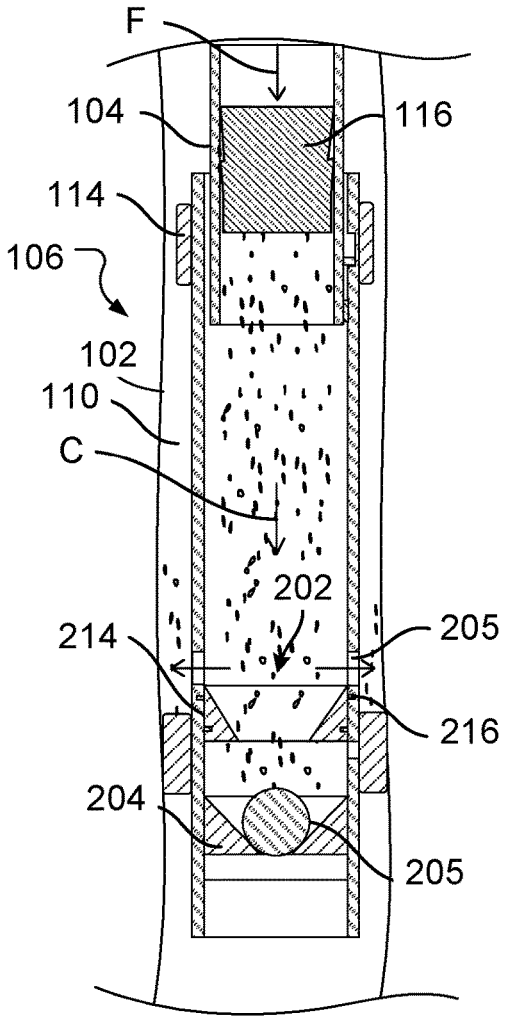

As shown in FIG. 4, once the valve 202 is opened (e.g., the pins 216 broken and the sleeve 214 shifted), the ports 215 are exposed to allow cement "C" to enter the annulus 110. The cement "C: flows from the wellbore string 104 to the cementing assembly 106, and from the cementing assembly 106 to the annulus 110 and the formations at the annulus 110. The cement "C" can be pushed downhole by a fluid "F" pushing wiper plug 116 that is uphole of the cement "C" to push the cement "C" to the annulus 110.

Figure 5:
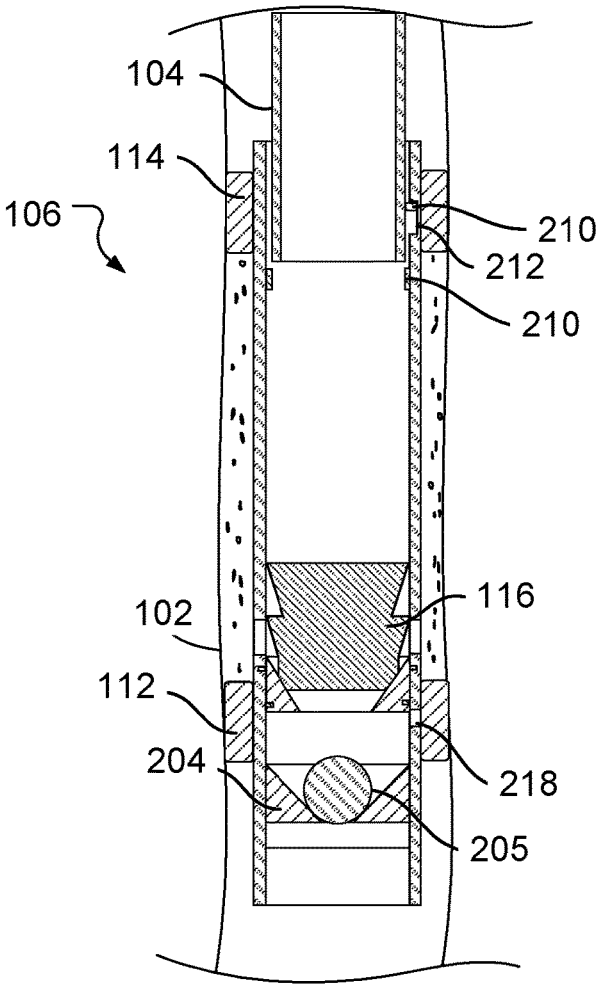

Once the cement "C" has be injected into the annulus 110 at the target zone, the ports 215 are closed either by the wiper plug 116 (as shown in FIG. 5) or by closing the valve 202. For example, further pressurizing the cementing assembly 106 to a third pressure greater than the second pressure can close the valve 202. The third pressure can be, for example, between 1500 and 2500 psi (e.g., 2000 psi) closing the port 205 prevents fluid from flowing between the annulus 110 and the bore of the cementing assembly 106.

As illustrated in FIG. 5, the wellbore string 104 sets the second packer 114 after flowing the cement and closing the port. To activate the second packer 114, the wellbore string 104 is first released from the cementing assembly 114 to allow the wellbore string 104 to mechanically activate the second packer 114. For example, the wellbore string 104 can be pushed or pulled to break the coupling or connection assembly 210 securing the wellbore string to the cementing assembly 106. In some implementations, the cementing assembly 106 can be pressurized to break or disengage the coupling 210. For example, the cementing assembly 106 can be pressurized to a fourth pressure greater than the second pressure to push a latch of the coupling 210 or otherwise disengage the coupling 210. The fourth pressure can be, for example, between 2500 and 3500 psi (e.g., 3000 psi).

Once the wellbore string 104 is disengaged from the cementing assembly 106, the wellbore string 104 engages a setting profile 212 of the second packer 114 to activate the packer 114 by mechanical movement of the wellbore string 104. For example, the wellbore string 104 can have a pin or outwardly projecting shoulder 210 that engages the setting profile to activate the packer 114.

After the second packer 114 is set, the wellbore string 102 can continue drill through the wiper plug 116, the ball seat 204, and the float equipment to establish fluid communication with the wellbore 102 downhole of the cementing assembly 106.

Figure 6:
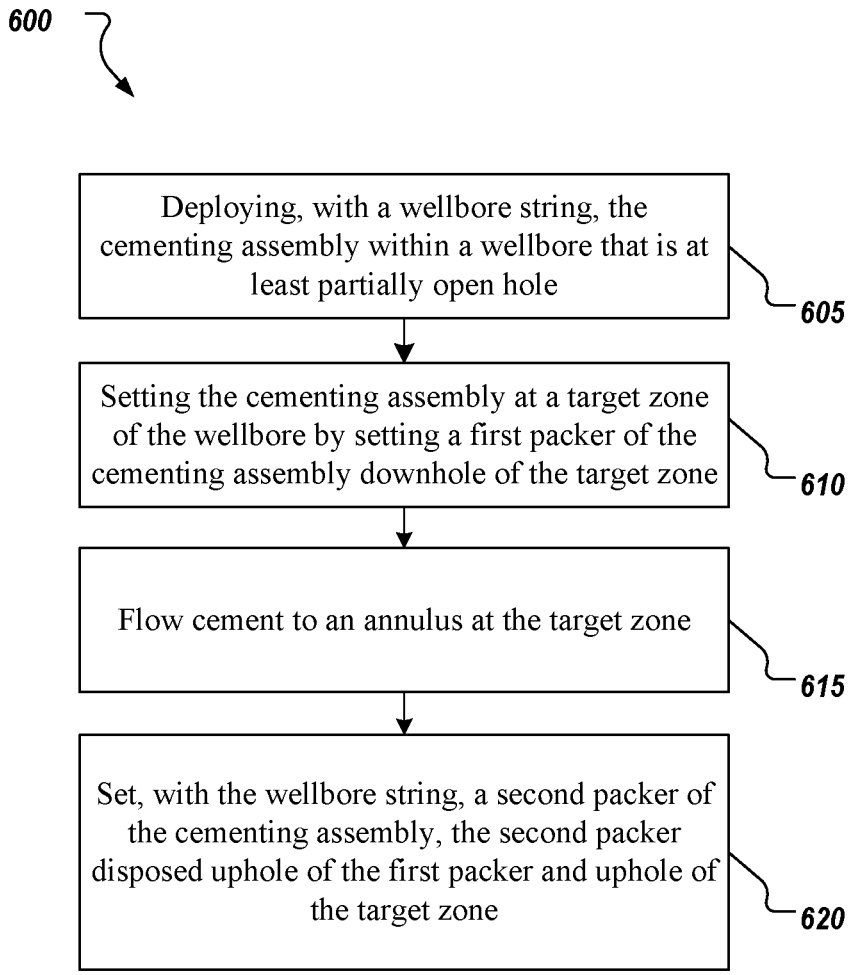
FIG. 6 is a flow chart of an example method of isolating a zone of a wellbore.

FIG. 6 shows a flow chart of an example method 600 of cementing a section of a wellbore. The method includes deploying, with a wellbore string coupled to a cementing assembly, the cementing assembly within a wellbore that is at least partially open hole (605). The method also includes setting the cementing assembly at a target zone of the wellbore by setting a first packer of the cementing assembly below the target zone (610). The method also includes flowing, through the wellbore string and through the cementing assembly, cement to an annulus at the target zone. The annulus is defined between an exterior surface of the cementing assembly and a wall of the wellbore (615). The method also includes setting, with the wellbore string, a second packer of the cementing assembly, the second packer disposed uphole of the first packer and uphole of the target zone (620).

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that the mere use of the term "first" and "second" does not require that there be any "third" component, although that possibility is contemplated under the scope of the present disclosure.

What is claimed is:

1. A method comprising:

deploying, with a wellbore string coupled to a cementing assembly, the cementing assembly within a wellbore that is at least partially open hole;

setting the cementing assembly at a target zone of the wellbore by setting a first packer of the cementing assembly downhole of the target zone;

flowing, through the wellbore string and through the cementing assembly, cement to an annulus at the target zone, the annulus defined between an exterior surface of the cementing assembly and a wall of the wellbore; and after flowing the cement, mechanically setting, with the wellbore string and after detaching the wellbore string from the cementing assembly, a second packer of the cementing assembly, the second packer disposed uphole of the first packer and uphole of the target zone.

2. The method of claim 1, wherein setting the first packer comprises hydraulically setting the first packer, and setting the second packer comprises (i) engaging, with an outwardly-projecting shoulder of the wellbore string, a setting profile of the second packer, and (ii) activating, with the setting profile engaged and by moving the wellbore string, the second packer.

3. The method of claim 2, wherein setting the first packer comprises:

placing a ball on a ball seat of the cementing assembly to close a fluid pathway of the cementing assembly, and pressurizing, with the fluid pathway closed, the cementing assembly to a first fluid pressure to activate the first packer.

4. The method of claim 3, further comprising, before flowing the cement and after setting the first packer, opening, by pressurizing the cementing assembly to a second fluid pressure greater than the first fluid pressure, a valve configured to regulate a flow of fluid between a bore of the cementing assembly and the annulus.

5. The method of claim 4, wherein the valve comprises a cementing circulating valve disposed inside a housing of the cementing assembly and between the first packer and the second packer, and opening the valve comprises shifting, under fluid pressure, a sleeve of the valve in a downhole direction to expose an aperture of a wall of the cementing assembly.

6. The method of claim 4, wherein flowing the cement comprises flowing a wiper plug uphole of the cement to push the cement to the annulus.

7. The method of claim 4, further comprising, before setting the second packer and after flowing the cement, closing, by pressurizing the cementing assembly to a third fluid pressure greater than the second fluid pressure, the valve to prevent fluid from flowing between the annulus and the bore of the cementing assembly.

8. The method of claim 4, further comprising, before setting the second packer and after flowing the cement, detaching, by pressurizing the cementing assembly to a fourth fluid pressure greater than the second fluid pressure, the wellbore string from the cementing assembly.

9. The method of claim 1, further comprising, before setting the second packer and after flowing the cement, detaching the cementing assembly, the detaching comprising at least one of: breaking a shear pin securing the wellbore string to the cementing assembly or deactivating a connection assembly securing the wellbore string to the cementing assembly.

10. The method of claim 1, wherein the cementing assembly is drillable and the wellbore string comprises a drill string.

11. The method of claim 10, further comprising drilling, with the drill string, the through the cementing assembly.

12. A wellbore assembly, comprising:

a wellbore string configured to be disposed within a wellbore;

a cementing assembly attached to and fluidly coupled to the wellbore string, the cementing assembly comprising:

a housing;

a first packer attached to the housing and configured to be activated hydraulically; and a second packer attached to the housing uphole of the first packer, the second packer configured to be mechanically activated, after the wellbore string is detached from the cementing assembly, by the wellbore string engaging a setting profile of the second packer;

wherein the wellbore string is configured to direct, with the first packer set on a wall of the wellbore, cement to an annulus defined between an external surface of the housing and the wall of the wellbore, and the wellbore string is configured to mechanically set, after cementing the annulus, the second packer, the annulus bounded between the first packer and the second packer.

13. The wellbore assembly of claim 12, wherein the cementing assembly comprises a ball seat configured to receive a ball that closes a fluid pathway of the cementing assembly to allow pressurization of the cementing assembly to set the first packer at a first fluid pressure.

14. The wellbore assembly of claim 13, wherein the cementing assembly comprises a float shoe disposed downhole of the ball seat, the float shoe configured to prevent reverse flow of fluid from downhole the float shoe into the cementing assembly.

15. The wellbore assembly of claim 13, wherein the cementing assembly comprises a valve disposed within the housing and configured to open under a second fluid pressure greater than the first fluid pressure by shifting downhole to expose a fluid port to allow cement to flow from a bore of the housing to the annulus.

16. The wellbore assembly of claim 15, wherein the valve is configured to close under a third fluid pressure greater than the second fluid pressure, blocking the fluid port.

17. The wellbore assembly of claim 15, wherein the wellbore string is releasably coupled to the cementing assembly, and the wellbore string is configured to detach, under a fourth fluid pressure greater than the second fluid pressure, from the cementing assembly to allow the wellbore string to engage a setting profile of the second packer to set the second packer.

18. The wellbore assembly of claim 12, wherein the first packer comprises a first open hole packer and the second packer comprises a second open hole packer, and the setting packer comprises setting the first packer on an open hole wall of the wellbore and setting the second packer on the open hole wall of the wellbore.

19. The wellbore assembly of claim 12, wherein the wellbore string comprises a drill string.

20. The wellbore assembly of claim 19, wherein the cementing assembly is a drillable cementing assembly, and the drill string is configured to drill through the cementing assembly after the cement has been set.

* * * * *